US010119739B2

(12) United States Patent
Dolan et al.

(10) Patent No.: US 10,119,739 B2
(45) Date of Patent: Nov. 6, 2018

(54) HAIL PRODUCING MACHINE

(71) Applicant: Accudyne Systems, Inc., Newark, DE (US)

(72) Inventors: Tracy Dolan, North East, MD (US); Steven Cope, Newark, DE (US); Jesse Brown, West Grove, PA (US); Kim Ferrara, Middletown, DE (US)

(73) Assignee: Accudyne Systems, Inc.

( * ) Notice: Subject to any disclaimer, the term of this patent is extended or adjusted under 35 U.S.C. 154(b) by 204 days.

(21) Appl. No.: 14/925,462

(22) Filed: Oct. 28, 2015

(65) Prior Publication Data

US 2017/0122636 A1 May 4, 2017

(51) Int. Cl.

| | |
|---|---|
| ***F25C 1/00*** | (2006.01) |
| ***F25C 1/06*** | (2006.01) |
| ***F25C 5/14*** | (2006.01) |
| ***F25C 5/20*** | (2018.01) |

(52) U.S. Cl.

CPC ..... *F25C 1/00* (2013.01); *F25C 1/06* (2013.01); *F25C 5/14* (2013.01); *F25C 5/20* (2018.01)

(58) Field of Classification Search

CPC ..... F25C 1/00; F25C 5/14; F25C 5/20; F25C 1/06

USPC ..... 62/66

See application file for complete search history.

(56) References Cited

U.S. PATENT DOCUMENTS 2,575,509 A * 11/1951 Bayston ..... A23G 9/20 426/67

* cited by examiner

*Primary Examiner* — Ana Vazquez

(74) *Attorney, Agent, or Firm* — Drinker Biddle & Reath LLP

(57) ABSTRACT

A hail producing machine includes at least one diffuser for mixing water and carbon dioxide. At least one heat exchanger is in flow communication with the diffuser for receiving the mixture. A refrigeration unit freezes the mixture to form an ice rod in the heat exchanger. The ice rod is ejected from the heat exchanger and is converted into hail stones by a molding station downstream from the heat exchanger.

9 Claims, 20 Drawing Sheets

HAIL PRODUCING MACHINE

BACKGROUND OF THE INVENTION

It is desired in some industries, such as in the insurance industry, to be able to test the ability of a structure to withstand damage from hail. Thus, for example, hail stones could be artificially produced and the stones could be projected against structural members to determine the degree of any damage on buildings using such members. Conventionally, hail stones were made in molds. Carbon dioxide was added to water and then poured into different size silicone half spheres. The spheres were then mated together and placed in a freezer. After two days the stones were removed from the molds and placed into the fine launching device. Unfortunately, the $CO_2$ would migrate to the outer surface of the hail stone making the density non-uniform.

It would be desirable to be able to make hail stones which have a uniform density. It would also be desirable if a machine or method could be provided for efficiently making the hail stones in a large quantity during a minimum time period.

SUMMARY OF INVENTION

An object of this is to provide a machine and method for making artificial hail stones wherein the hail stones have a uniform density.

A further object of this invention is to provide such a machine and method which lends itself to the efficient mass production of such hail stones.

In accordance with this invention water and $CO_2$ are mixed in at least one diffuser. The mixture is then supplied to a heat exchanger where the mixture is frozen into an ice rod. The ice rod is then ejected from the heat exchanger into a mold to incrementally form hail stones from the ice rod.

In a preferred practice of this invention the ice rod is ejected from the heat exchanger by an air cylinder and is discharged from the heat exchanger into a staging tube. The ice rod is then fed from the staging tube into the mold while a new ice rod is being formed in the heat exchanger. Preferably, the formed hail stones exit from the mold on a novel gravity track into a compartmentalized freezer.

In a further preferred practice of this invention a plurality of diffusers and a plurality of heat exchangers and a plurality of staging tubes are provided so that multiple ice rods can be simultaneously formed. Similarly, a plurality of air cylinders would be selectively connected to the appropriate heat exchangers.

The novel gravity track preferably comprises a plurality of generally aligned pivotable levers with each lever disposed over a compartment or chamber in a freezer. In a preferred practice the upper end of a lever is nested in the lower end of its adjacent lever to provide a continuous track. During use a hail stone would roll down the gravity track and off the outermost lever into its chamber. When the hail stone passes the pivot line of the outermost lever, the lever is pivoted upwardly. When the hail stone drops into the chamber the lever returns to its aligned position with the other levers. This continues until there is no more room in the outermost chamber and the outermost lever remains in its pivoted position. Subsequent hail stones then drop from the next lever and this process is repeated until all of the chambers are filled.

THE DRAWINGS

FIG. 1 schematically illustrates some of the main components of the hail producing machine in accordance with this invention;

DETAILED DESCRIPTION

Figure 1:
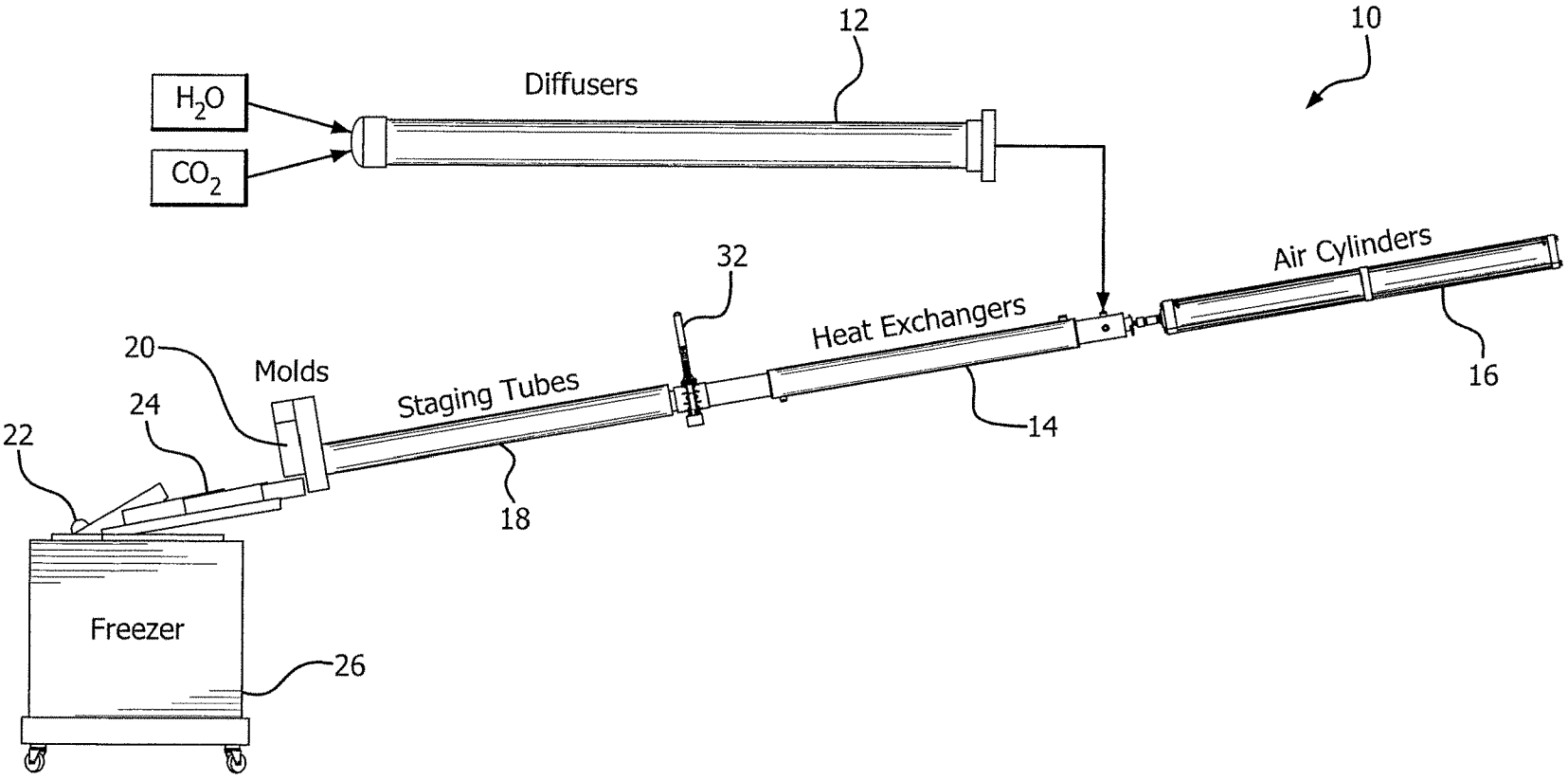
Figure 2:
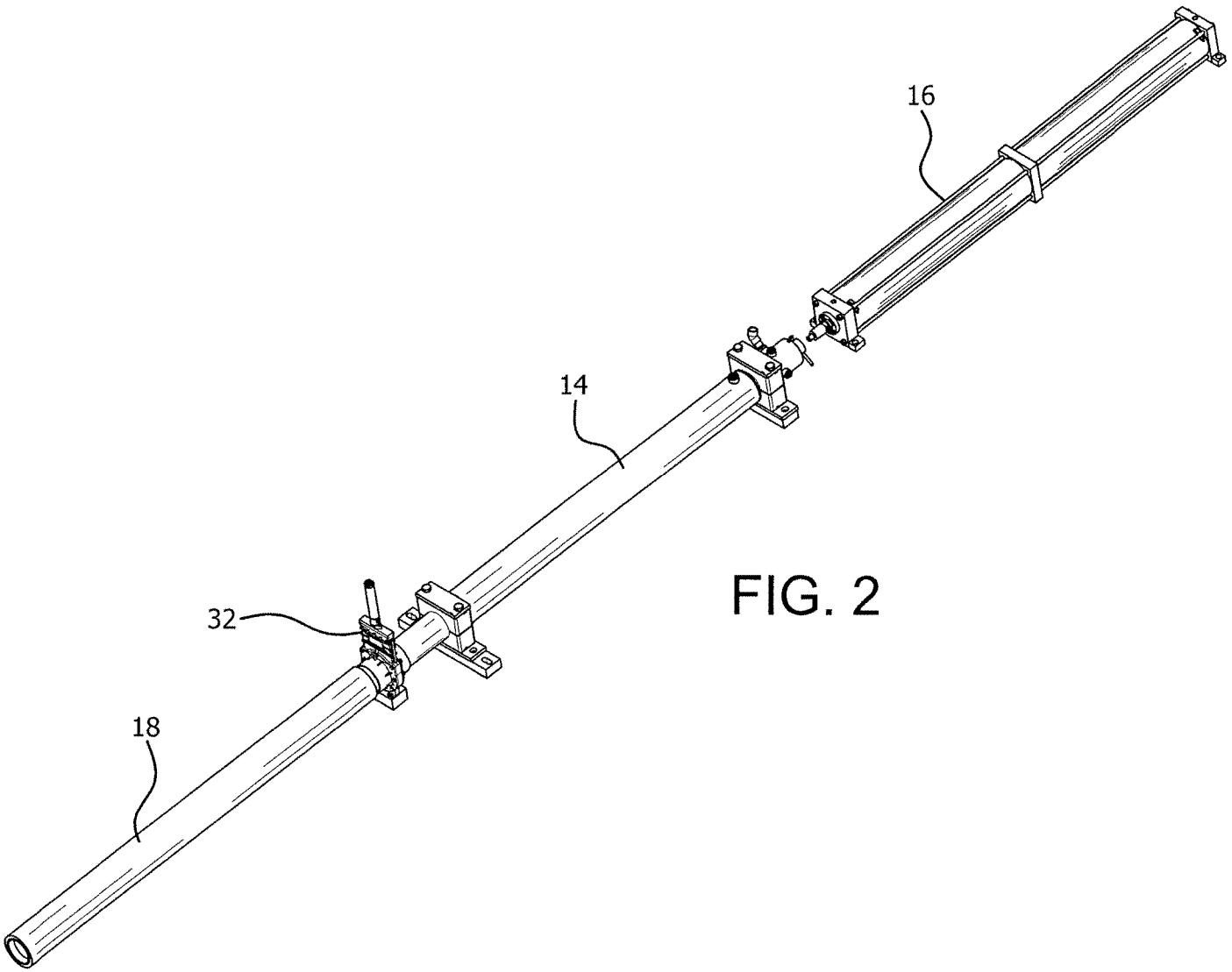
FIG. 2 is a perspective view illustrating an air cylinder, a heat exchanger and a staging tube in the hail producing machine of FIG. 1.

FIG. 1 illustrates the basic components in the hail producing machine 10 in accordance with this invention. As shown therein, water and carbon dioxide are fed into at least one diffuser 12. The mixture is then fed into a heat exchanger 14 where the mixture is frozen into an ice rod. The ice rod is ejected from the heat exchanger by an air cylinder 16. The ejected ice rod is fed into a staging tube 18 and incrementally fed from the staging tube into a molding station 20 where the hail stones 22 are formed. The hail stones 22 roll down a gravity track 24 into a multi-compartmented freezer 26. A single set of heat exchanger 14, air cylinder 16 and staging tube 18 is shown in FIG. 2. A gate valve 32 controls communication between heat exchanger 14 and staging tube 18.

Figure 3:
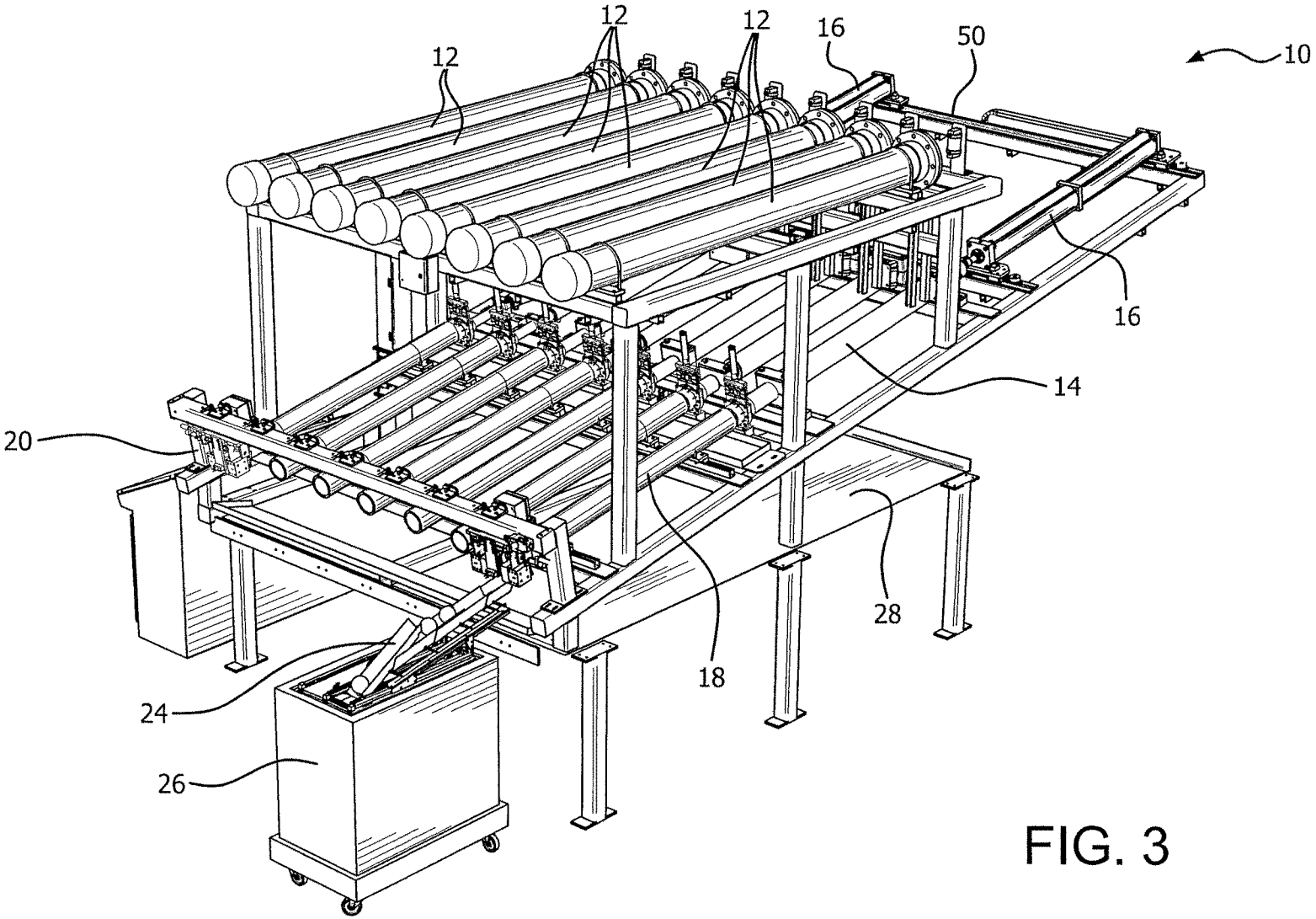
FIG. 3 is a perspective view of a hail producing machine in accordance with this invention.

FIG. 3 illustrates a preferred machine 10. The machine 10 is modular, allowing later addition of molds for other stone sizes and shapes as well as additional heat exchangers to produce different diameter ice rods. A water catch pan 28 is located under all wet process components to capture spill, leaks, and the melted water created during the forming process. The pan 28 directs all water to a single drain point for disposal or recirculation. The machine is equipped with a plurality, preferably seven heat exchangers 14 to make hail stones 22 of, for example, diameters 1", 1.25", 1.5", 1.75", 2", 2.5", 3", and 3.5" with capacity of up to 500 stones/day from any two sizes simultaneously. The process controls stone densities in the range of 0.5-0.9 g/cc.

The production system uses tap water passed through a cartridge filter (not shown) to remove sediment but not dissolved solids which are believed to act as nucleation points for $CO_2$ bubble formation and ice formation. The filtered water is routed with valves to a series of horizontal diffusers 12 which may be PVC pipes approximately 8" OD×10' long. Eight diffusers are illustrated. $CO_2$, under low pressure, pads the head space of the pipes 12 and is allowed to diffuse into the water for 48 hours. Two pipes 12 provide enough water to produce 1000-2" diameter stones, so a minimum of 6 pipes are required for continuous operation. This setup eliminates issues with incomplete $CO_2$ dispersion in the incoming water and helps provide a uniform distribution of small bubbles in the ice stones to control stone density.

Figure 15:
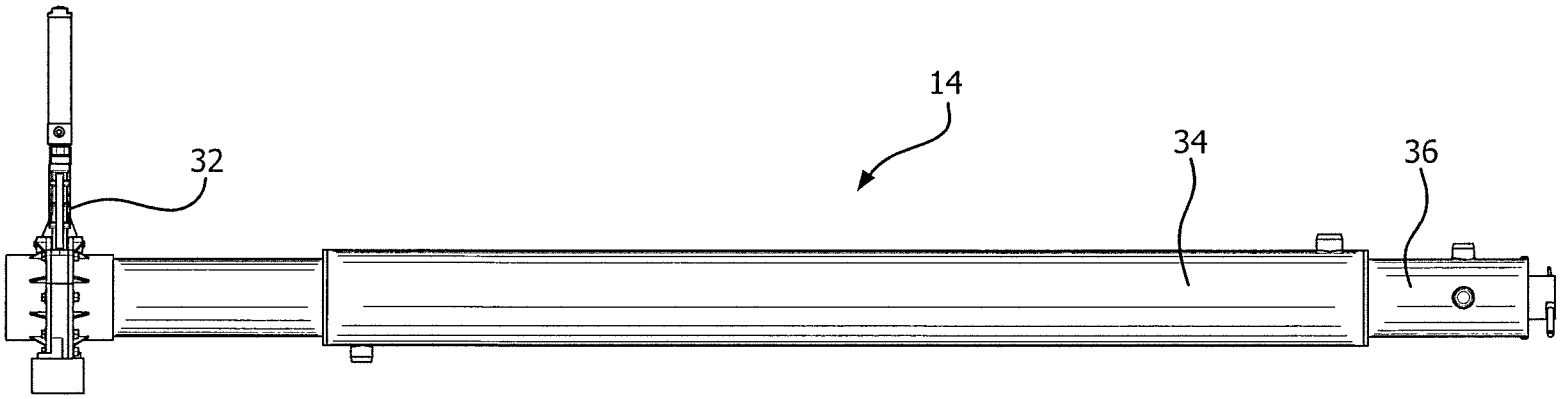
FIG. 15 is a side elevational view showing the heat exchanger in the machine of FIG. 3 according to this invention and showing a gate valve for controlling flow communication of the heat exchanger with a staging tube.

The $CO_2$/water mixture is supplied via valves to any two heat exchanger modules. A heat exchanger module consists of a tube-in-tube heat exchanger 14 used to freeze an ice rod of appropriate diameter, a refrigeration unit 30 (FIG. 6) to remove heat, and a heated molding system 20 to form the hail stones. The design of the heat exchanger 14 is a basic tube-in-tube exchanger where water enters the inner tube 36 in liquid form. A gate valve 32 (FIGS. 4 and 15) at the lower end of the inner tube 36 is closed to prevent the water from leaking. Gate valve 32 is opened during the extrusion process, once the water forms an ice rod. Refrigerant is circulated in the outer tube 34 in the annulus between the outer tube 34 and the inner tube 36. When the refrigeration unit 30 is running the water is cooled to −30 F until the water in the inner tube 36 is completely frozen. The refrigeration unit 30 can be a packaged scroll compressor and evaporator which supplies Refrigerant 404 at approximately −30 degrees F. to condense in the shell of the heat exchanger 14 to allow for a rapid freezing of the water/$CO_2$ mix within the heat exchanger. During freezing, pressure is applied to the water/$CO_2$ mix to control the volume of bubbles produced and thus the density of the ice rod and subsequent ice stones. Following a timed freeze cycle, the refrigeration system is switched to circulate hot gas within the heat exchanger 14 to thaw a thin layer of fluid at the wall of the exchanger, allowing the ice rod to be pushed out of the heat exchanger 14 via an attached air cylinder 16. The free-thaw cycle is controlled and thus limited by the larger of the two heat exchangers 14 in the forming process. Two long-stroke air cylinders 16 are provided which must be adjusted to mate with the two heat exchangers 14 for the size stones desired to be produced. The air cylinders 16 apply over 1000 psi to the ice rod to help break it free from the wall of the inner tube 36.

The process of ejecting the ice rod into the staging tube 18 and out of the heat exchanger 14 leaves heat exchanger 14 empty while the ice rod is being segmented into hail stones. Having the heat exchanger 14 empty during the hail stone forming permits the immediate re-fill of the heat exchanger 14 with another batch of water/$CO_2$ and the freeze cycle to be initiated while stone forming is progressing. Splitting these processes permits a near doubling of the number of ice stones produced compared to a prototype process without a staging tube.

Figure 6:
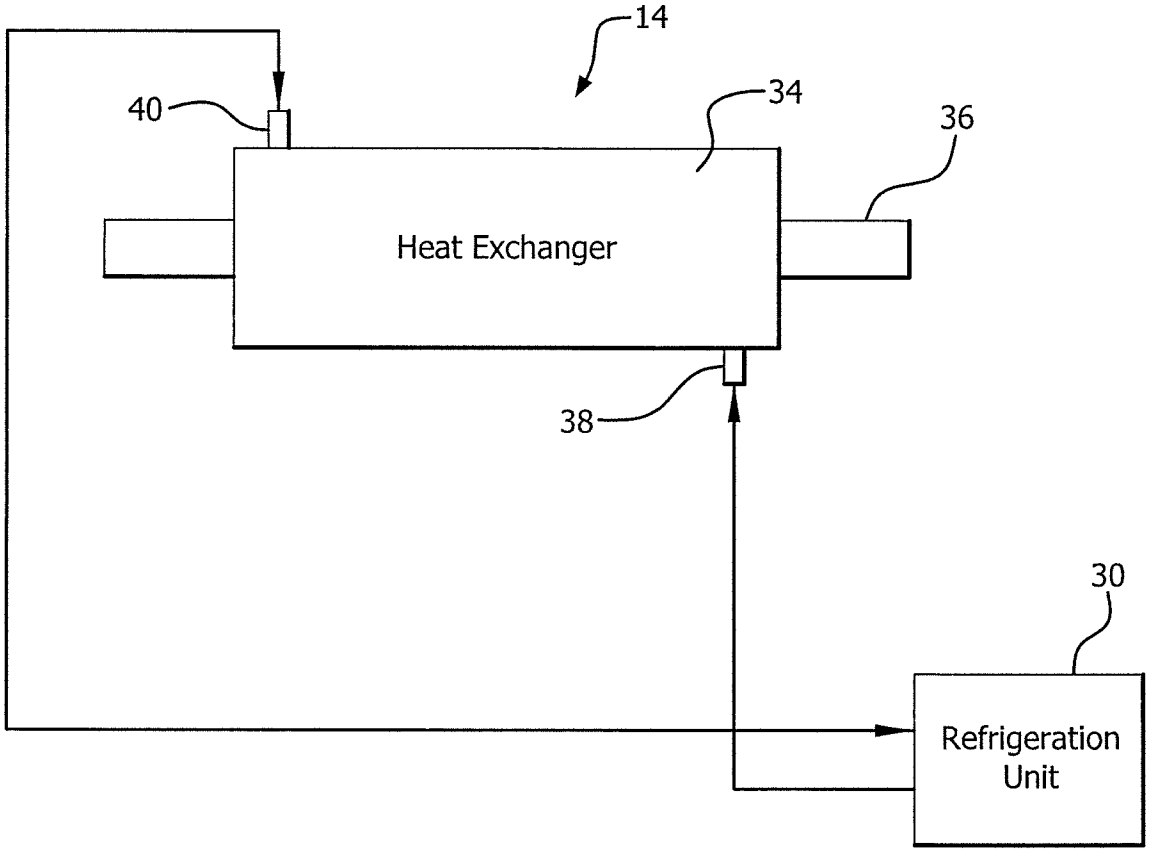
FIG. 6 is a schematic view showing the flow communication between a heat exchanger and a refrigeration unit.
Figure 7:
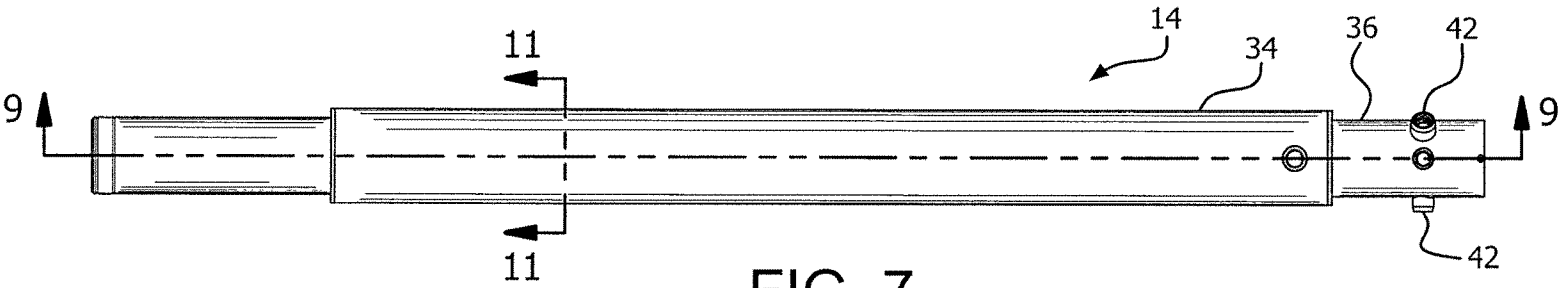
FIG. 7 is a side elevational view of a heat exchanger in accordance with this invention.
Figure 8:
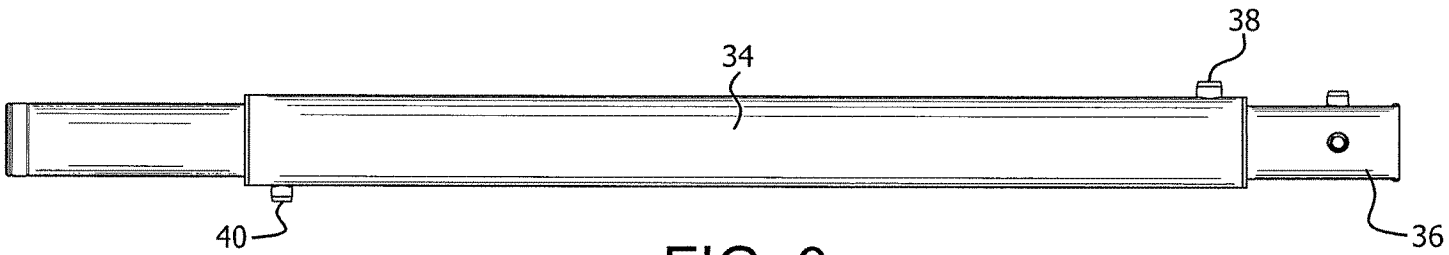
FIG. 8 is a top plan view of the heat exchanger shown in FIG. 7.
Figure 9:
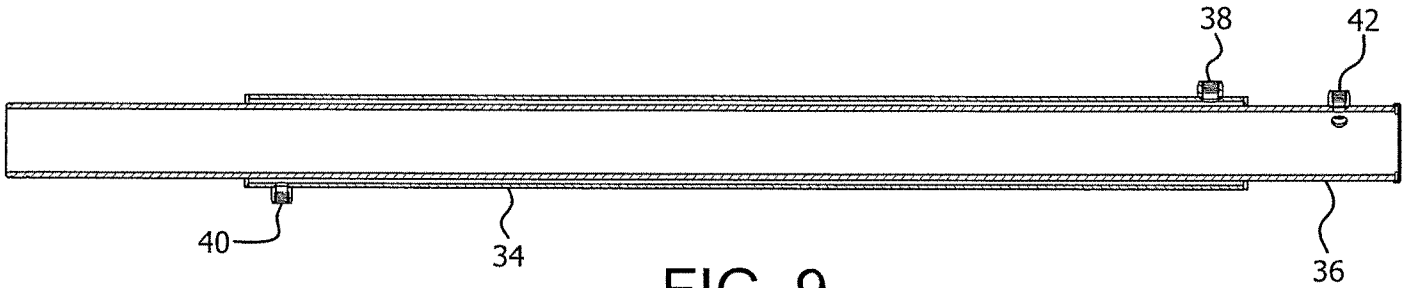
FIG. 9 is a cross-sectional view taken through FIG. 7 along the line 9-9.
Figure 10:
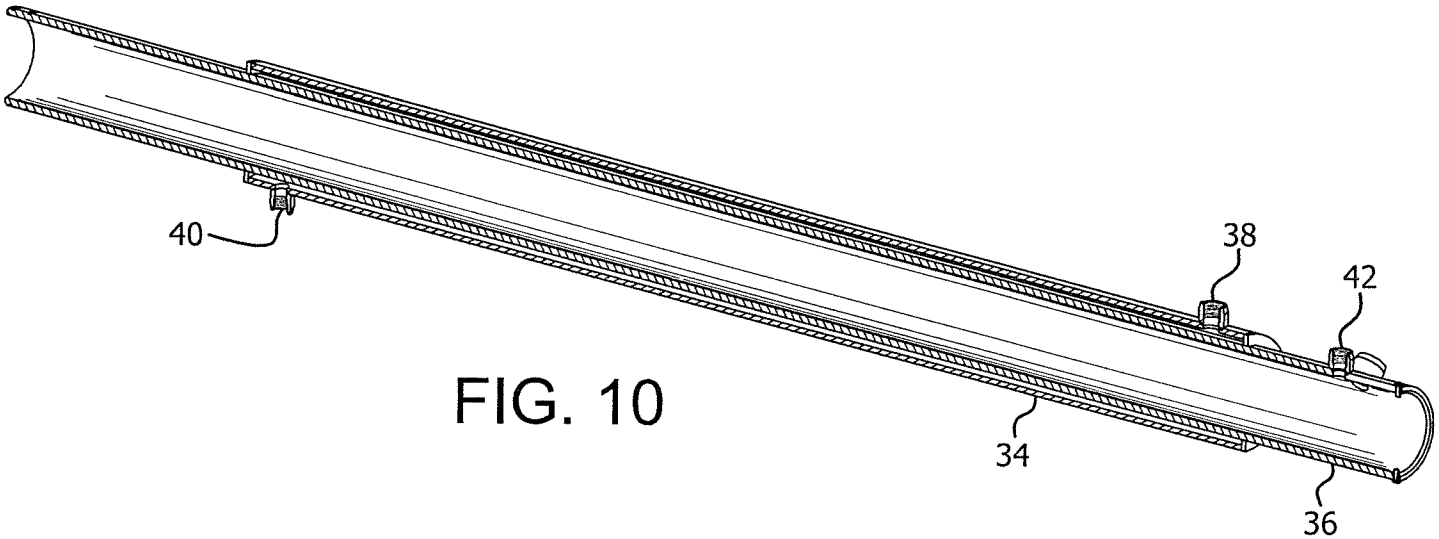
FIG. 10 is a cross-sectional view of the heat exchanger shown in FIGS. 7-9.
Figure 12:
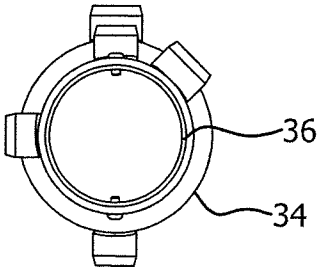
FIG. 12 is an end view of the heat exchanger shown in FIGS. 7-11.
Figure 11:
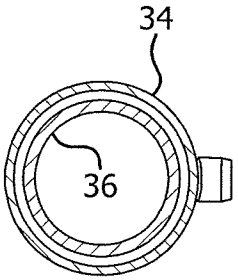
FIG. 11 is a cross-sectional view taken through FIG. 7 along the line 11-11.

FIG. 6 illustrates the flow communication between heat exchanger 14 and refrigeration unit 30. As shown therein, heat exchanger 14 comprises an outer tube 34 and an inner tube 36. This tube-in-tube structure is better shown in FIGS. 7-12. As shown therein, outer tube 34 has a pair of outwardly extending connectors 38,40. As shown in FIG. 6 refrigeration unit 30 is in flow communication with the connectors 38,40 so that the refrigeration unit 30 can selectively cool the inner tube 36 during the ice rod formation and circulate hot gas when it is desired to thaw a thin layer of fluid at the wall of the heat exchanger.

Inner tube 36 of heat exchanger 14 also has connectors 42 at its upstream end. This permits a tube to be connected between a diffuser 12 and inner tube 36 to supply the water/$CO_2$ mixture to the heat exchanger 14. This can be done by the use of a manifold wherein tubing extends from the diffusers to the manifold and then from the manifold to the heat exchangers. The heat exchangers could also be provided with level switches.

Figure 13:
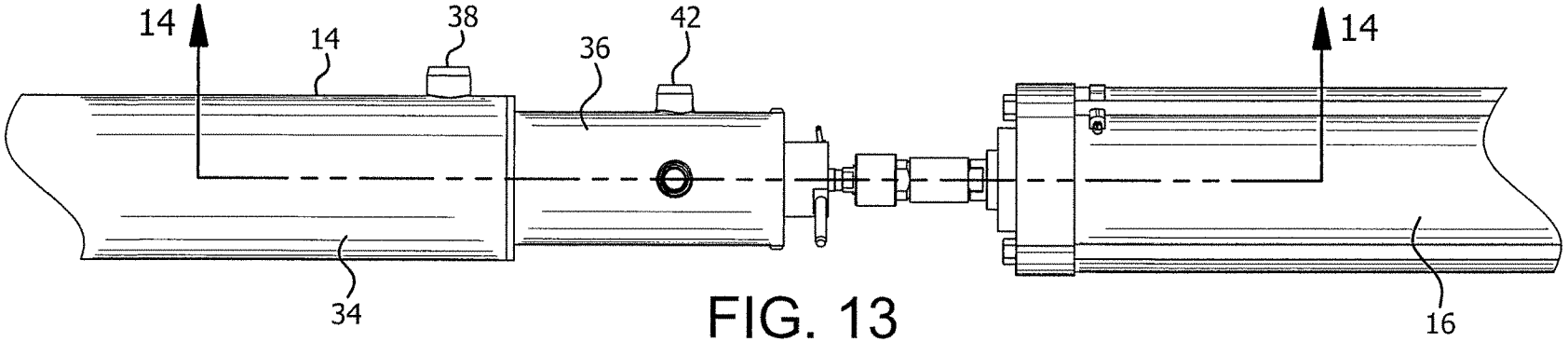
FIG. 13 is a side elevational view showing the connection of an air cylinder and heat exchanger in accordance with this invention.
Figure 14:
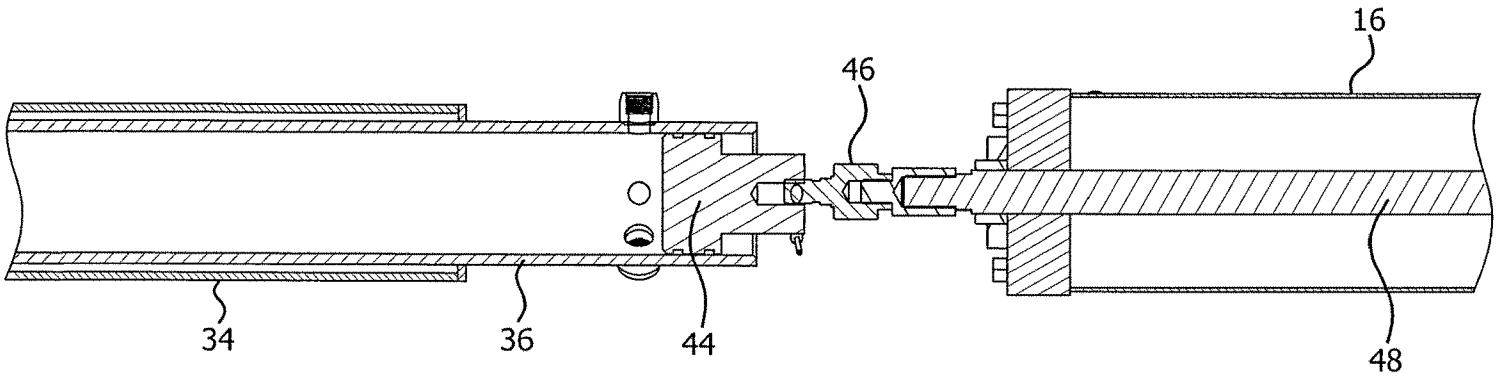
FIG. 14 is a cross-sectional view taken through FIG. 13 along the line 14-14.

During freezing pressure is applied to the mixture in the inner tube 36 via the pneumatic air cylinders 16 that apply up to 1000 psi to the frozen ice rod. FIGS. 13-14 show the connection between a heat exchanger 14 and an air cylinder 16. As shown therein, a plug 44 has two O-ring seals which seal the upper end of the inner tube 36. The lower end of the inner cylinder is closed by gate valve 32. A pin 46 connected to rod 48 within air cylinder 16 selectively mates with plug 44. When the thin layer of fluid at the wall of the heat exchanger 14 is formed the ice rod is pushed out of the heat exchanger by the pressure from air cylinder 16 which can be over 1000 psi to help break the ice rod free from the wall of the inner tube 36.

Thus, it is easier to extrude the ice rod out of the inner tube and/or the amount of pressure to extrude the ice rod is less by first thawing the layer of fluid at the wall of the heat exchanger. The air cylinders 16 are mounted on linear rails 50 (FIG. 5) so that an operator can position the respective air cylinders 16 to work with any of the heat exchangers 14.

Figure 4:
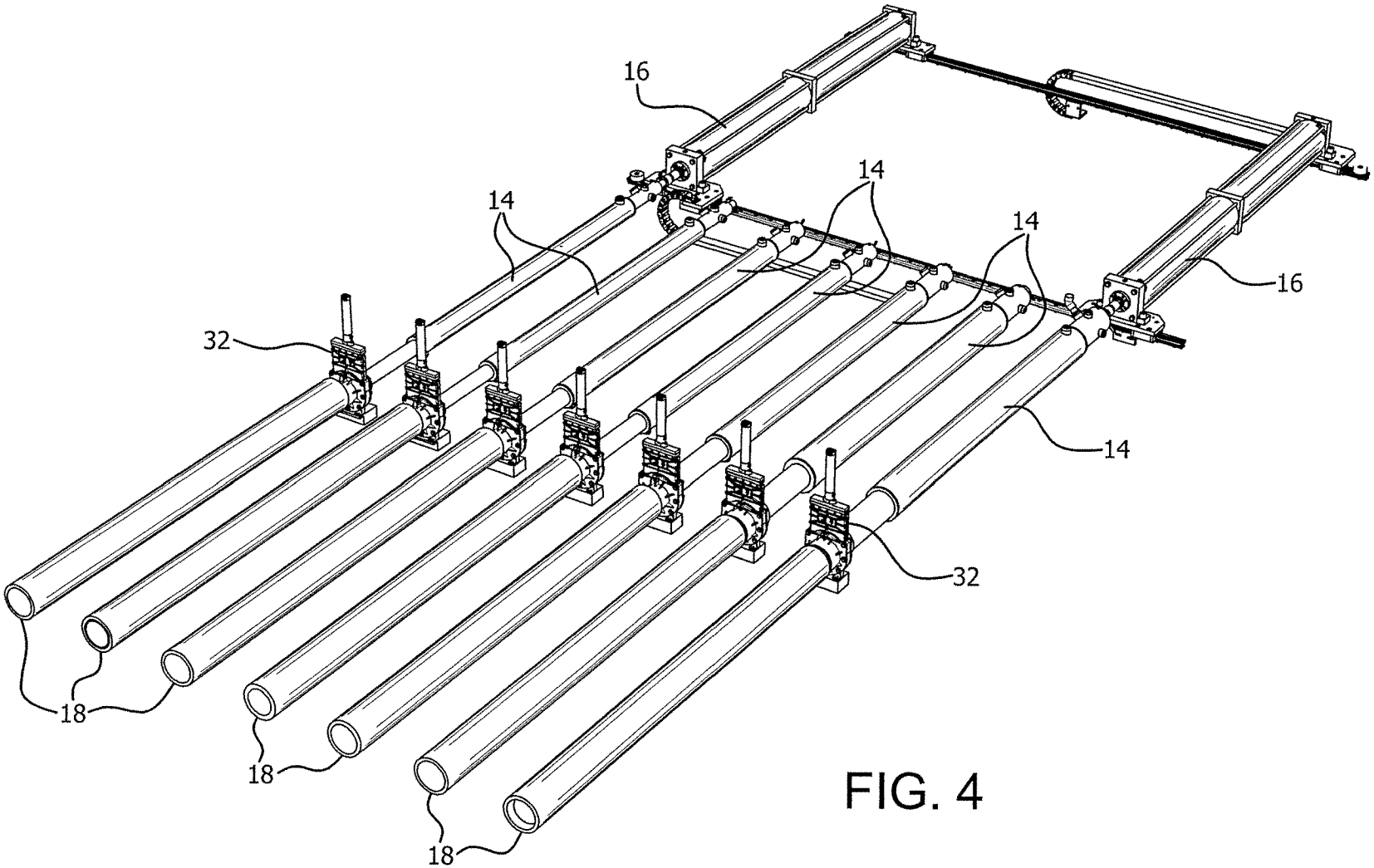
FIG. 4 is a perspective view of the air cylinders, heat exchangers and staging tubes in the machine of FIG. 3.
Figure 5:
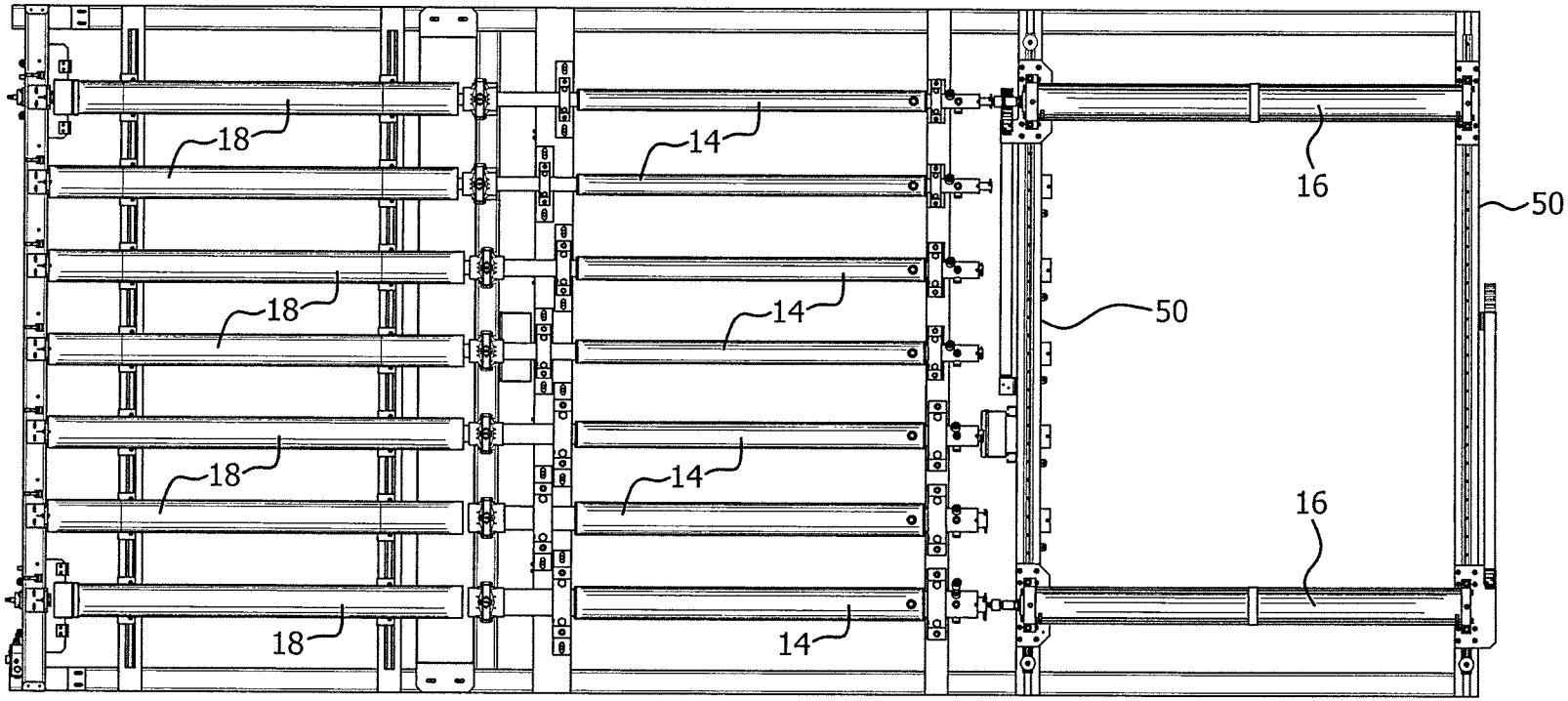
FIG. 5 is a top plan view of FIG. 4.

As shown in FIGS. 3-5 each heat exchanger 14 is mounted in selective flow communication with a staging tube 18. As illustrated the heat exchangers have differing diameters to facilitate the making of hail stones of different sizes. The diffusers 12, however, as well as the air cylinders 16 and the staging tubes 18 are all of uniform diameter. As also illustrated while the diffusers 12 are horizontal, the air cylinders 16 and the heat exchangers 14 and the staging tubes 18 are all aligned with each other and inclined downwardly toward the end of the staging tubes.

During the freezing process the lower end of heat exchanger 14 is sealed by gate valve 32 to close communication between the heat exchanger 14 and the staging tube 18. The communication is opened by actuation of the gate valve 32.

The ejected ice rod is deposited into an oversize insulated staging tube 18. The tube 18 directs the ice rod into the actuated split heated hemispherical molds at an aligned molding station 20. Where the machine 10 is operated by simultaneously using two heat exchangers 14, the two air cylinders 16 are positioned at the two heat exchangers 14 and two molding stations 20 are positioned at the corresponding staging tube associated with the two heat exchangers. Two freezers 26 would be moved to the two molding stations 20.

Figure 16:
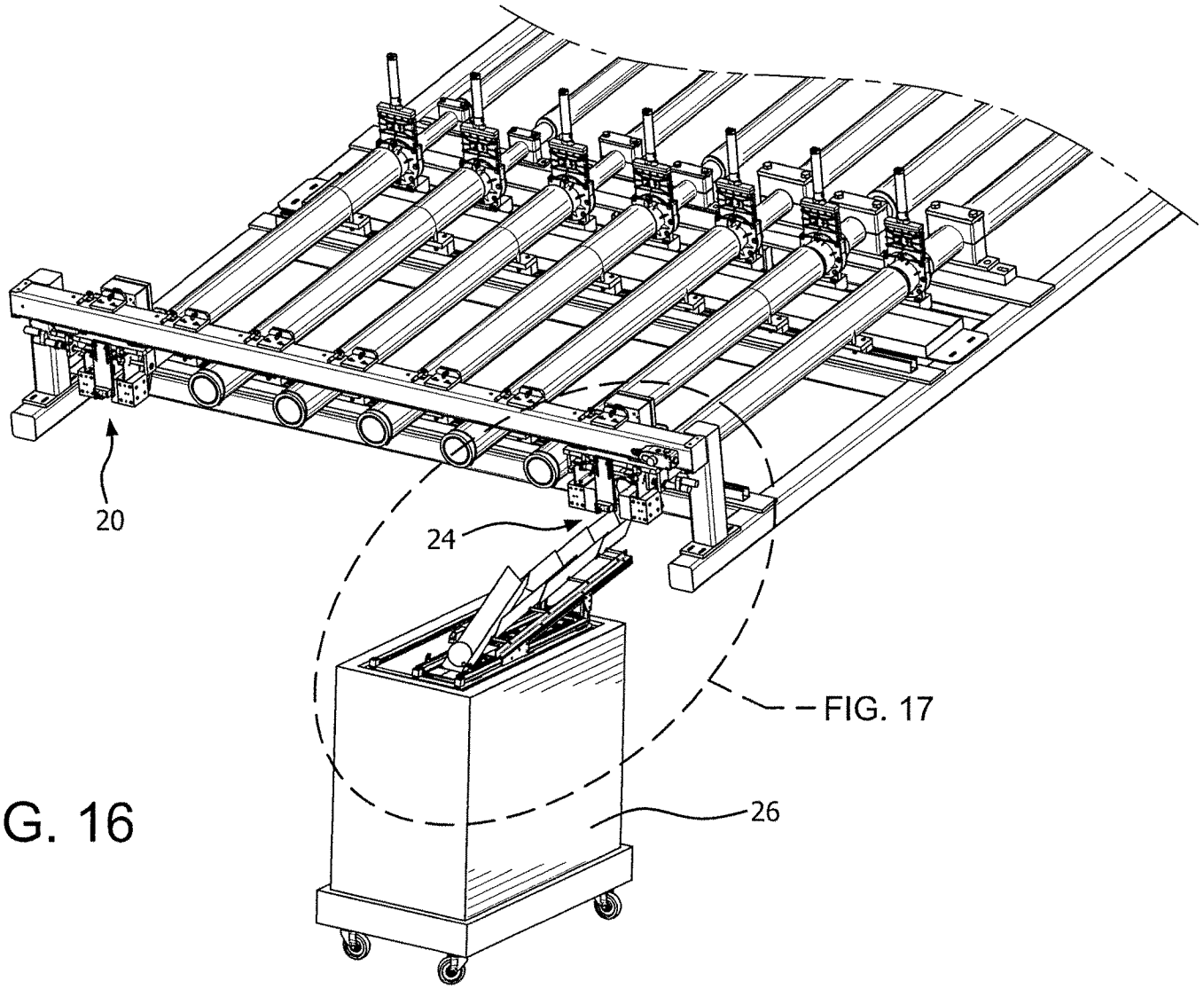
FIG. 16 is a perspective view showing the formation of hail stones from an ice rod being ejected from a staging tube.
Figure 17:
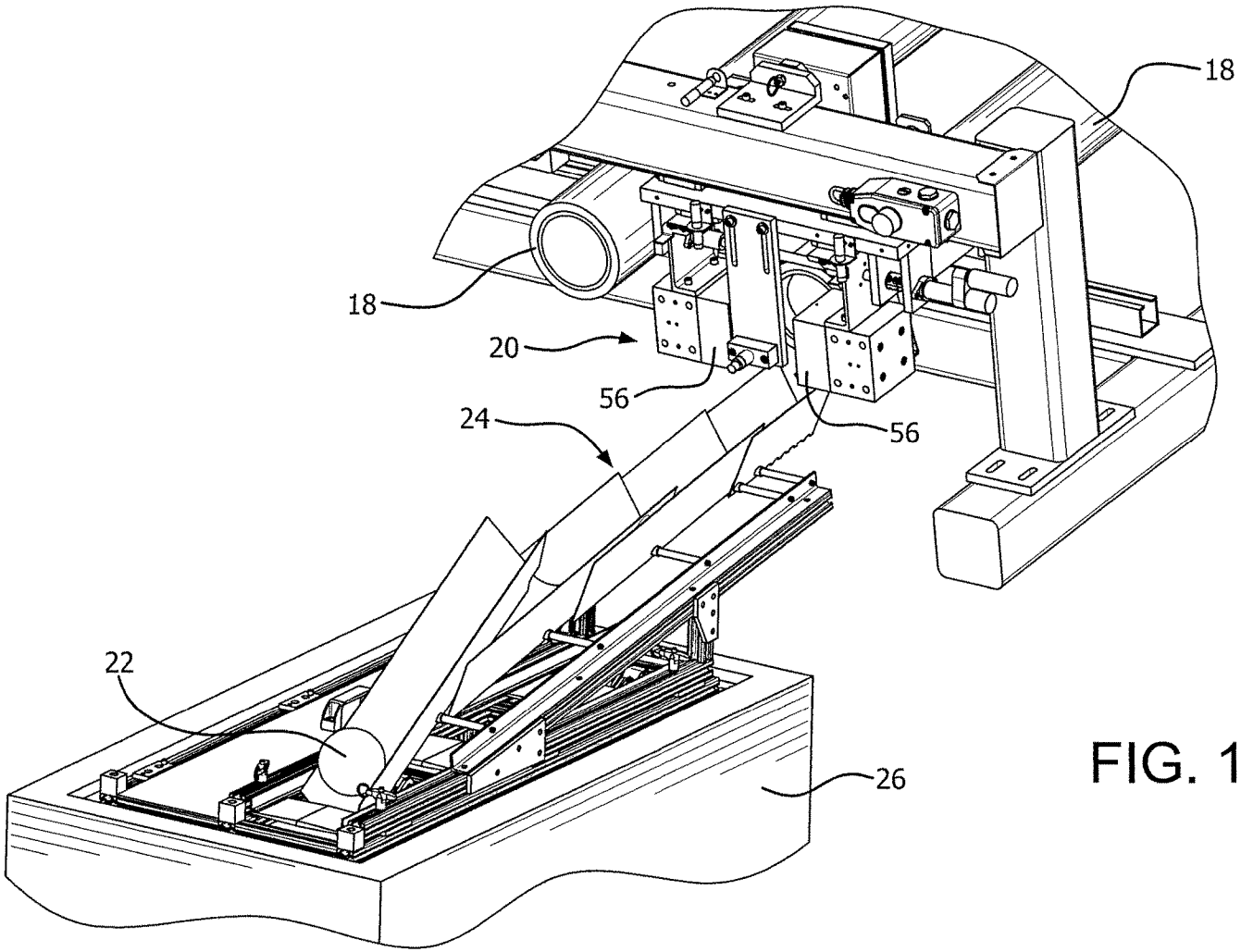
FIG. 17 illustrates the portion of FIG. 16 indicated by the dashed lines.
Figure 23:
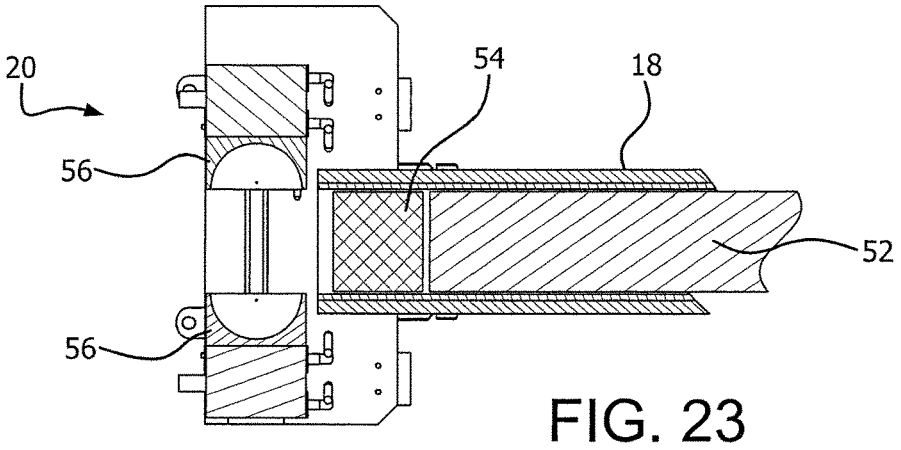
FIGS. 23-25 show the steps in forming a hail stone in accordance with this invention.
Figure 24:
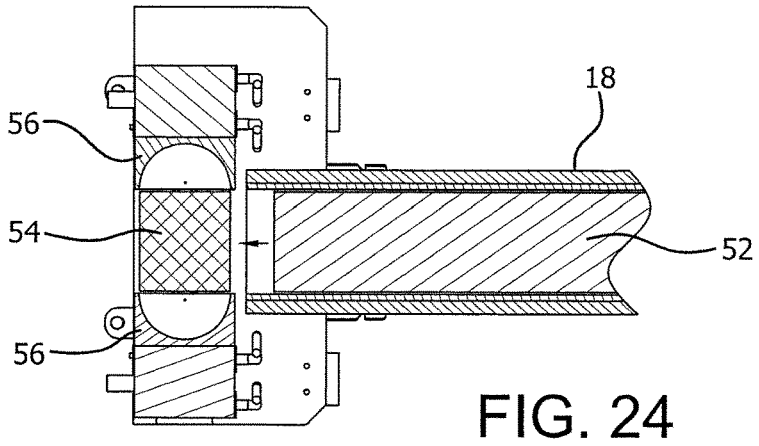
Figure 25:
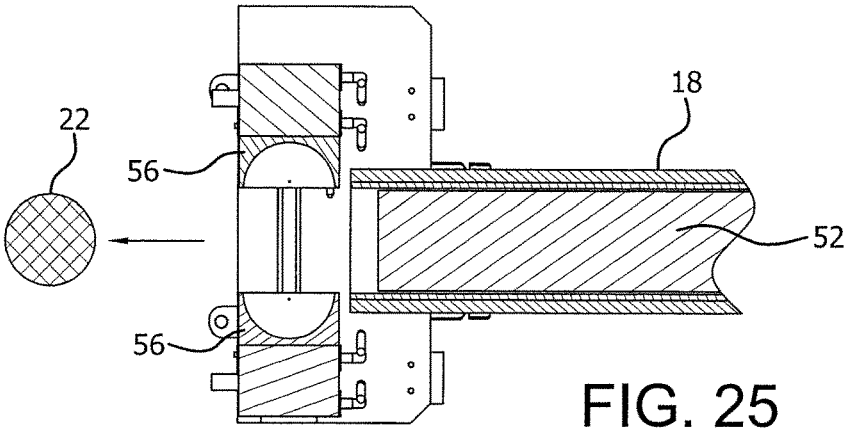

FIGS. 23-25 illustrate the sequence in utilizing the molds to form the hail stones. As shown in FIG. 23 the ice rod 52 in staging tube 18 is incrementally pushed forward out of staging tube 18 until its outermost portion 54 is located between the split heated hemispherical molds 56,56, as shown in FIG. 24. The molds 56,56 then move toward each other and a hail stone 22 is formed, as shown in FIG. 25. The hail stone 22 is dropped onto the gravity track 24 where the hail stone 22 is then deposited into a chamber of freezer 26. See FIGS. 16-17.

Two mold actuation systems 20 are provided which accept any size mold. The two systems must be aligned with the heat exchanger 14 and its corresponding staging tube 18 required to produce the desired stone size.

Figure 21:
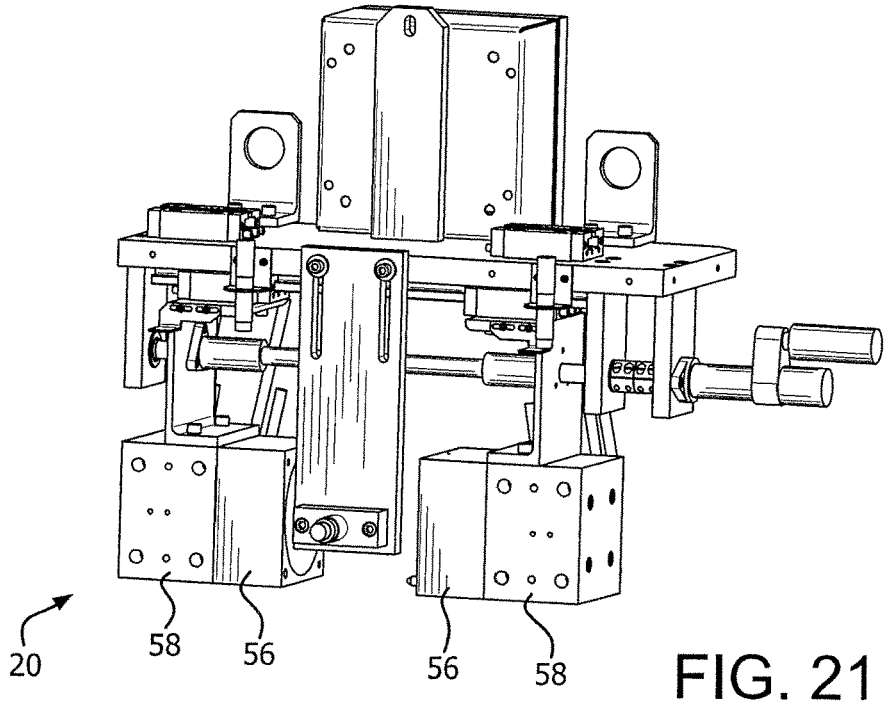
FIG. 21 is a front perspective view showing the mold system of this invention.
Figure 22:
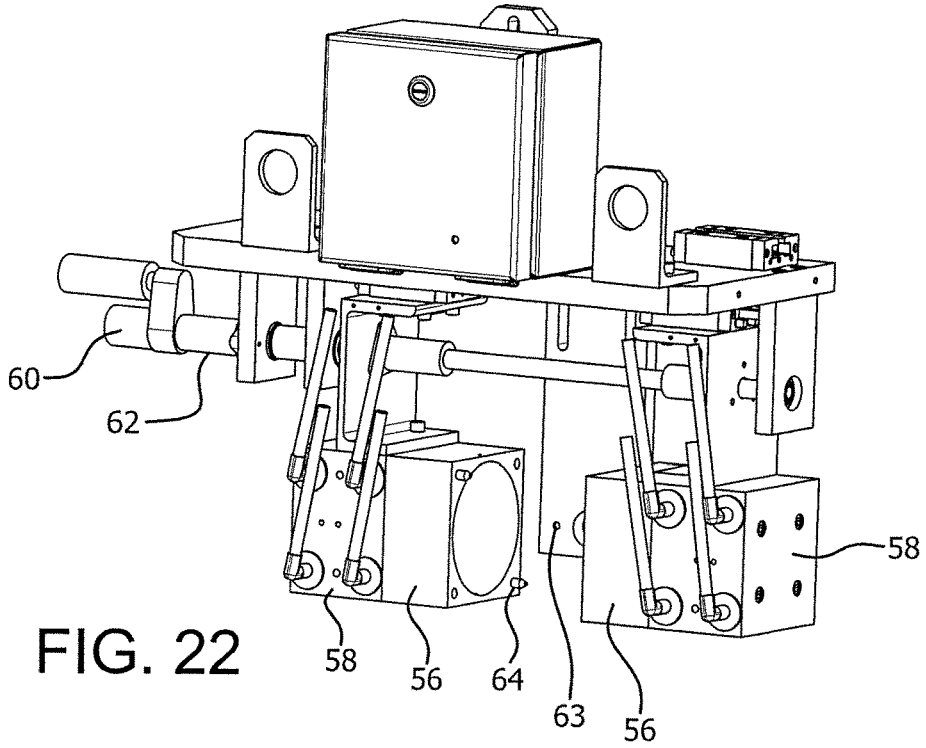
FIG. 22 is a rear perspective view of the mold system shown in FIG. 21.

FIGS. 21-22 show the details of a mold station or actuating system 20. Each mold 56 is detachably mounted to a heater block 58. As also illustrated, an air motor 60 operates a double oppositely threaded screw 62 to move the heater blocks and molds towards and away from each other by means of the illustrated links extending from the heater box. The molds 56 mount directly to the universal heating block 58 via easy access bolts allowing for quick changes from one mold size to another. The molds 56 include alignment pins to ensure proper mating after installation into the mold actuating system. Compliance in the heated blocks 58 allows for minor adjustments as needed. As illustrated in FIG. 22 a sensor 63 detects the presence of the ice rod portion 54 between the molds 56,56.

In the preferred practice of this invention, there are eight interchangeable stone molds to provide hail stones corresponding to the different diameters of the heat exchangers 14. The operator would manually move each mold assembly 20 to the correct heat exchanger.

Figure 18:
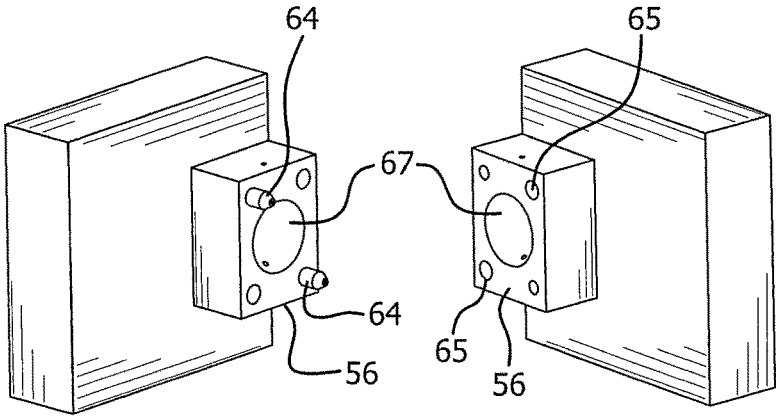
FIGS. 18-20 are perspective views of different molds which can be used in the machine of this invention.
Figure 19:
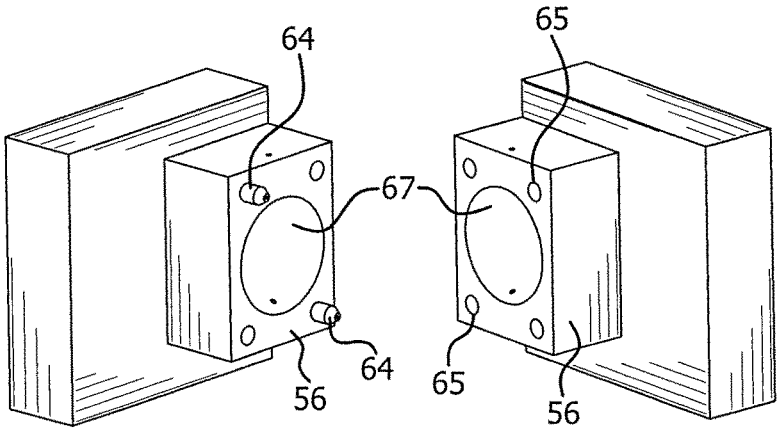
Figure 20:
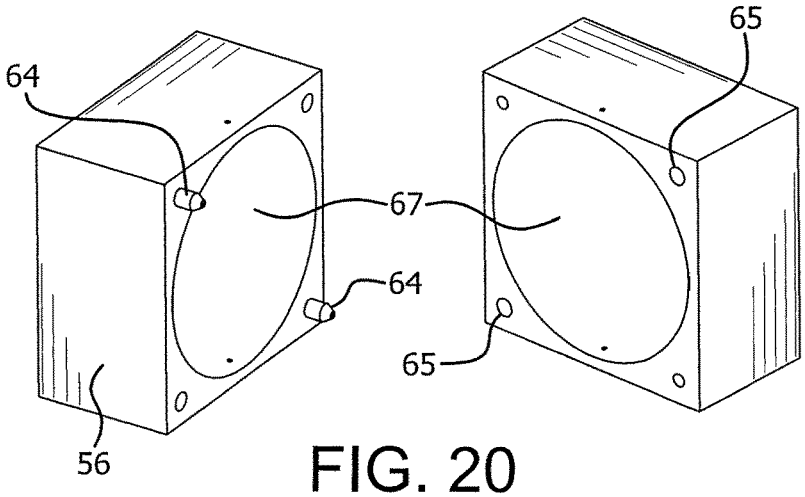
Figure 26:
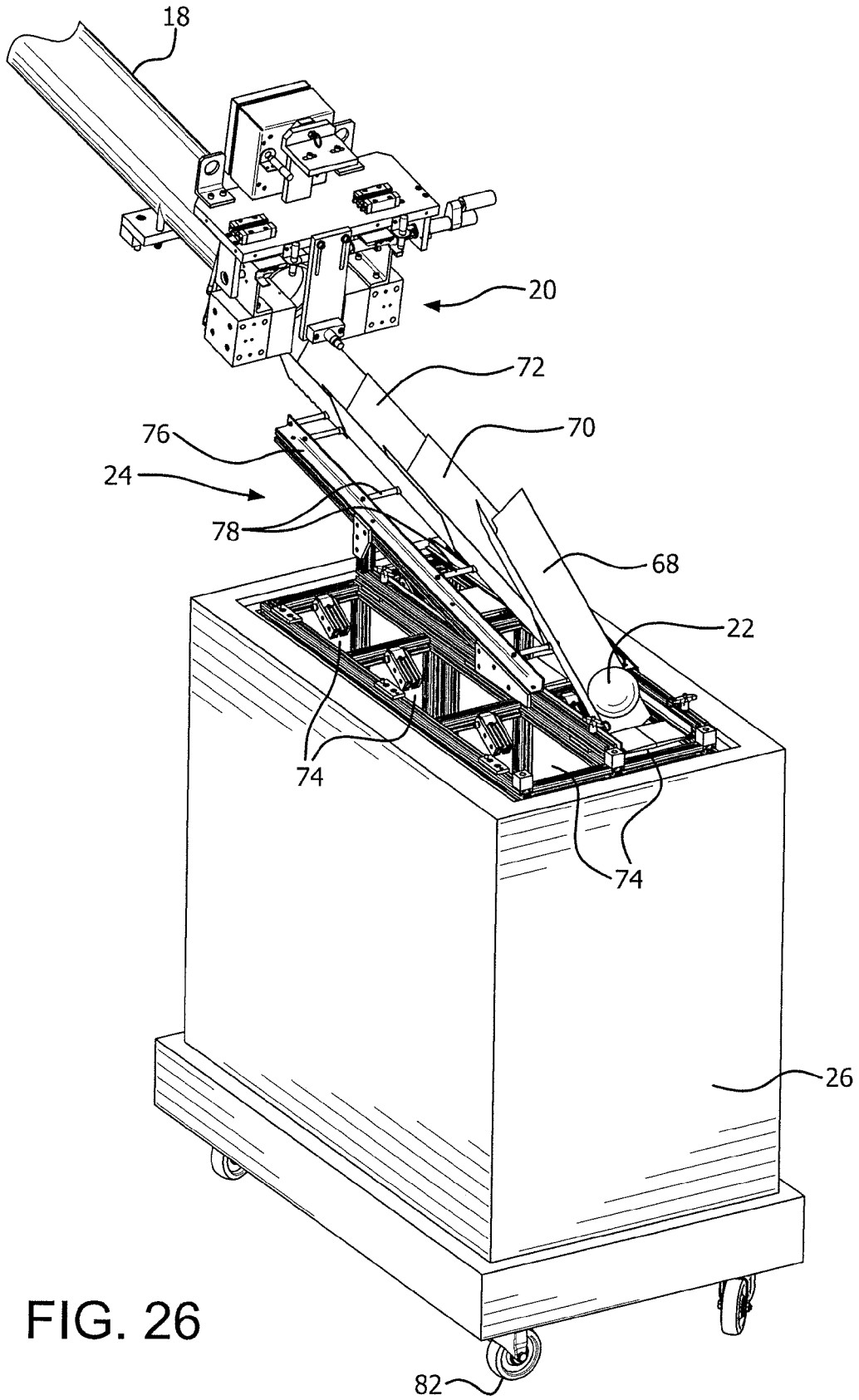
FIG. 26 is a perspective view showing use of a gravity track in the machine of this invention.
Figure 27:
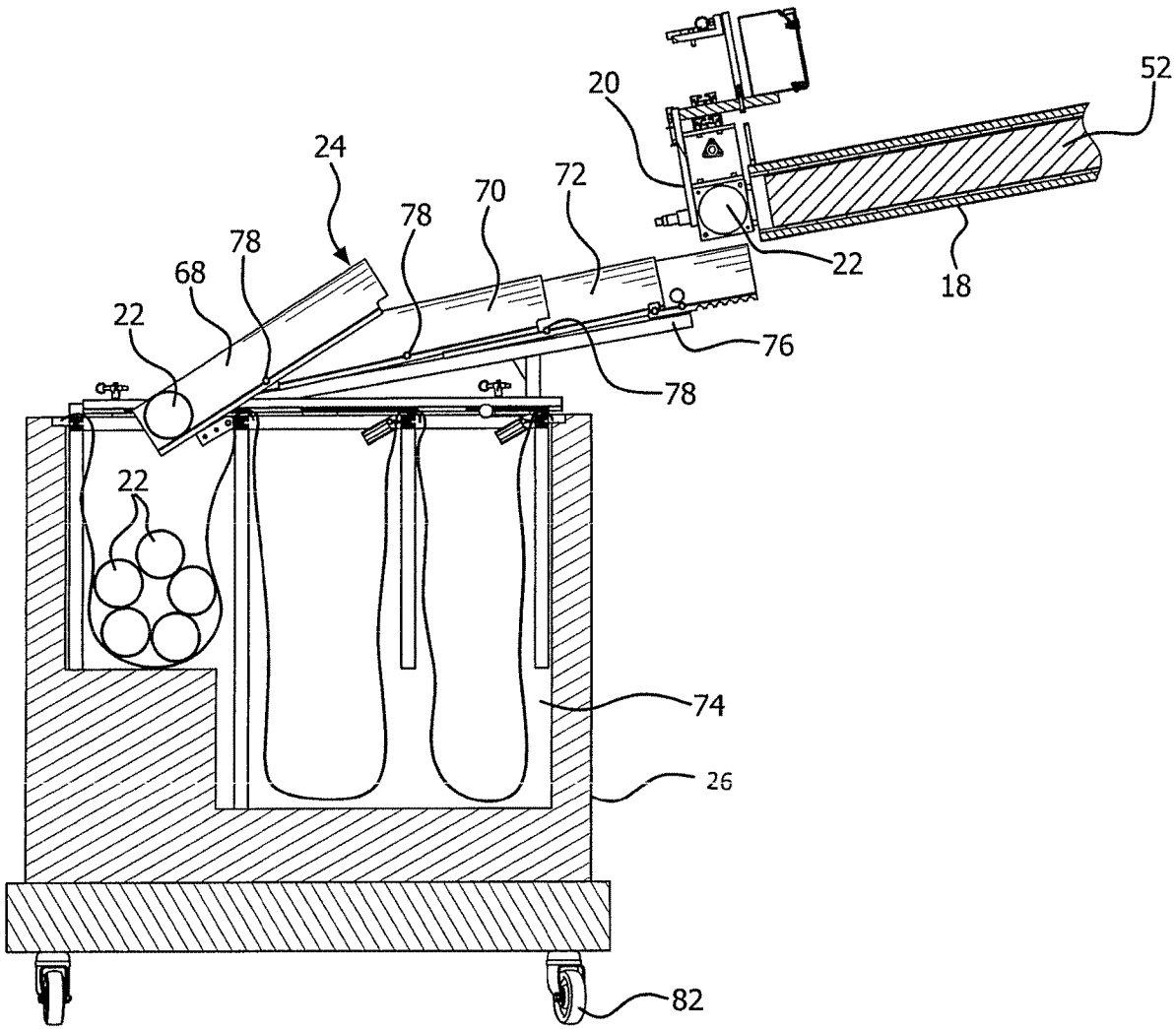
FIG. 27 shows a stage in the use of the gravity track of this invention.

FIGS. 18-20 illustrate various forms of molds 56. As shown therein one of the molds 56 in each set would include a pair of aligning pins 64 which enters a corresponding hole 65 in the mating mold 56. As illustrated, the hemispherical cavity 67 in the various molds 56 are of different size corresponding to the intended size of the hail stones. Once the stone 22 is formed and the mold 56 is opened the stone 22 is dropped into a gravity track 24 which distributes the stones 22 to chambers inside the portable chest freezer 26. The distribution system deposits the stones at most 18" above the storage containers which is the maximum the stones can be dropped without damage. The ice rod 52 then indexes into the open mold, and the cycle repeats until the ice rod is completely converted into stones. The gravity track 24 is a passive system comprised of a series of three levers 68,70,72. The three levers 68,70,72 distribute the stones into six separate chambers 74 of the freezer 26. See FIG. 26.

Figure 28:
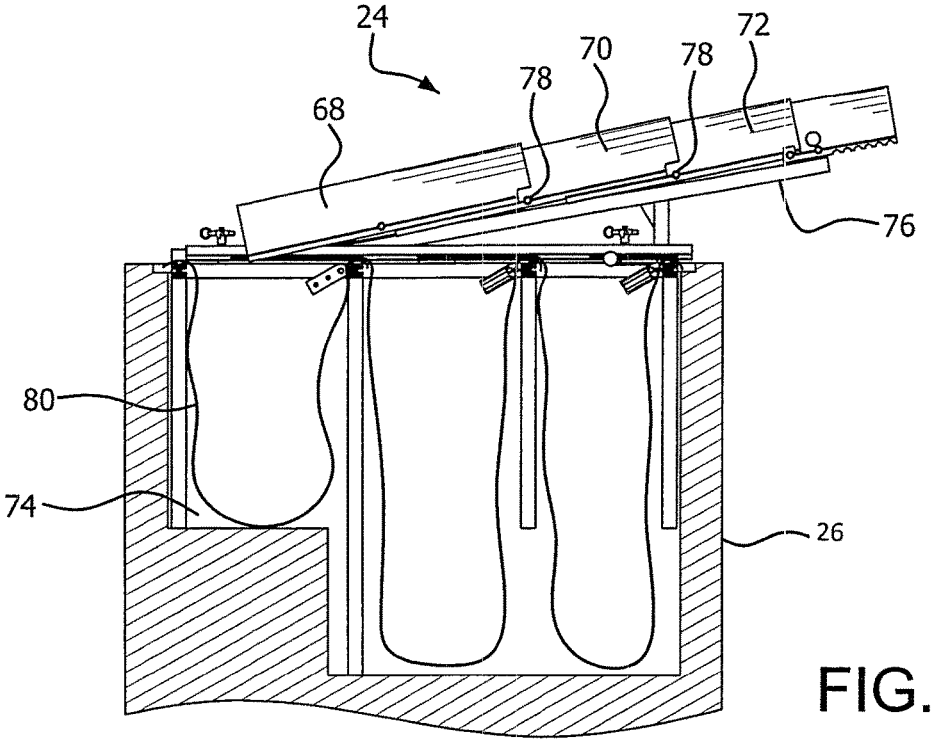
FIGS. 28-32 show the sequence of operation of the gravity track in accordance with this invention.
Figure 29:
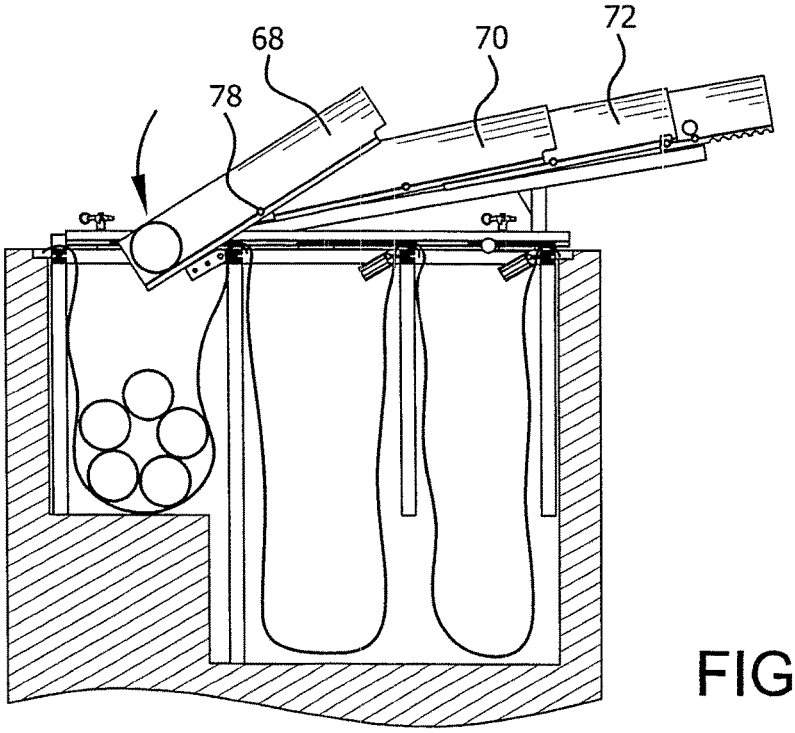
Figure 30:
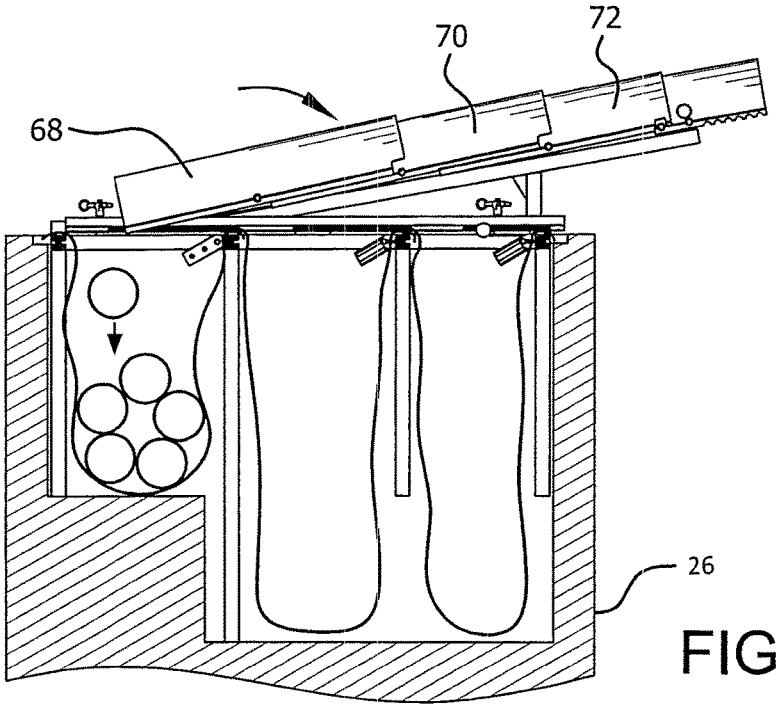
Figure 31:
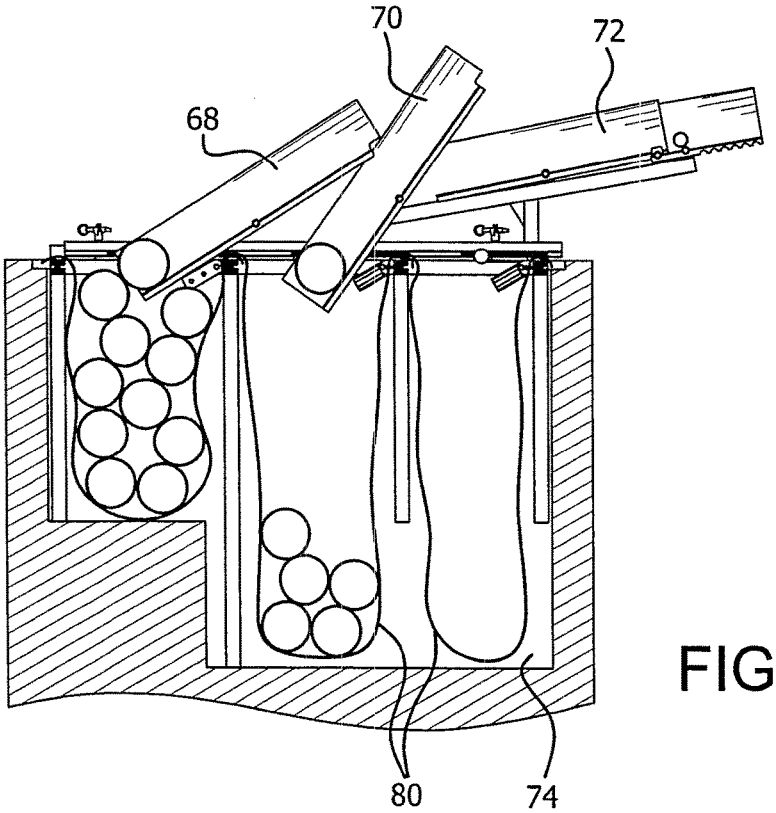
Figure 32:
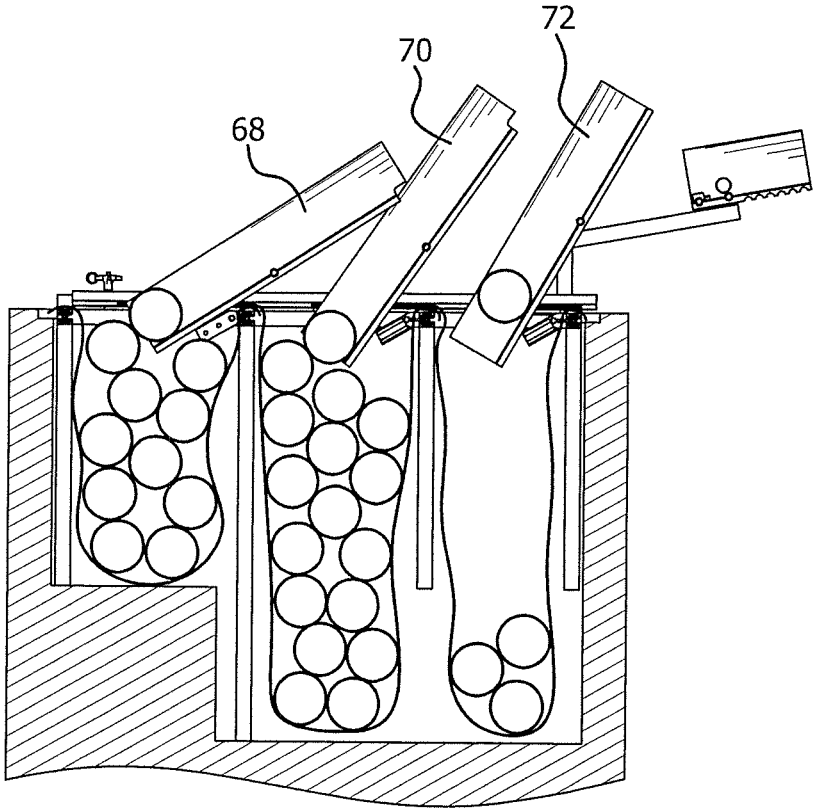

FIGS. 26-32 illustrate the operation of gravity track 24. As shown, in particular, in FIG. 26 gravity track 24 includes a support having side rails 76. Each of the levers 68,70 and 72 is pivotally mounted on a shaft 78 connected to the parallel side rails 76. The location of each shaft 78 is such that the weight of a hail stone past shaft 78 causes the lever to pivot upwardly. The levers 68,70 and 72 are trough shaped such as being curved or of V-shape and nest in each other. Thus, the upper portion of lever 68 nests in the lower portion of lever 70 and lever 70 nests in lever 72. This creates a continuous track from the generally aligned nested levers. Initially, as shown in FIG. 28, all of the levers are aligned in their nested condition. When a hail stone 22 is dropped from the mold station 20 the hail station rolls down the inclined gravity track and drops from outermost lever 68 into the outermost chamber 74 of freezer 26. Preferably, a soft bag 80, such as made of polyethylene is detachably mounted in each respective chamber 74 to collect the hail stones 22. FIG. 29 illustrates the filling of the outermost compartment. As illustrated, when a hail stone 22 travels past the pivot shaft 78 the weight of the hail stone on lever 68 causes lever 68 to rotate upwardly or counter-clockwise. After the hail stone drops from lever 68, lever 68 returns to its original position as illustrated in FIG. 30. This process continues until there is no more room in the bag 80 for the hail stone 22 to fall from lever 68. As a result, the last hail stone causes lever 68 to remain in the pivoted condition. The next hail stone then travels down the gravity track and is deposited by lever 70 into the intermediate chamber 74. See FIG. 31. This process continues until the bag 80 in the intermediate chamber is filled which results in intermediate lever 70 remaining in the pivoted condition. As shown in FIG. 32 the process continues with the hail stones being deposited by inner lever 72 into its innermost chamber 74 until its bag 80 is full.

It is to be understood that while the above description relates to the preferred practice of this invention, wherein the gravity track includes three levers and the freezer 26 has six compartments, the invention may be practiced with a differing number of levers and freezer compartments. Similarly, while the above description relates to a preferred practice of this invention regarding the specific number of diffusers, air cylinders, heat exchangers, staging tubes and mold stations, the invention could be practiced with differing numbers. In order to maximize the production of the hail stones it is preferred that there should be a plurality of each of the above noted components.

As illustrated, freezer 26 is mounted on wheels 82 to permit the freezer 26 to be easily moved from one location to another. The chest freezer 26 conditions the stones 22 to a controlled temperature prior to firing them from an air cannon and also serves as the transport container to the top of the wind tunnel. Once filled, the chest freezers 26 are manually removed and replaced with empty freezers.

What is claimed is:

1. An artificial hail producing machine comprising at least one diffuser for mixing water and $CO_2$, at least one heat exchanger in selective flow communication with said diffuser for receiving a water/$CO_2$ mixture from said diffuser, a refrigeration unit communicating with said heat exchanger for forming an ice rod in said heat exchanger from the water/$CO_2$ mixture, and at least one heated molding system downstream from said heat exchanger for forming artificial hail stones from the ice rod, including at least one air cylinder for selective communication with said heat exchanger for ejecting the ice rod from said heat exchanger, at least one staging tube in selective communication with said at least heat exchanger for receiving the ice rod from said heat exchanger and feeding the ice rod to said molding system, and a freezer for collecting the hail stones formed from the ice rod.

2. The machine of claim 1 wherein there are a plurality of said diffusers and of said heat exchangers and of said air cylinders and of said staging tubes and of said molding systems.

3. The machine of claim 2 wherein a set of at least two but less than all of said diffusers are simultaneously in flow communication with a corresponding set of heat exchangers, said corresponding set of heat exchangers being simultaneously in flow communication with a corresponding set of staging tubes, said air cylinders being in simultaneous communication with said set of heat exchangers, and said molding systems being in simultaneous communication with said set of staging tubes.

4. The machine of claim 3 wherein each of said heat exchangers comprises an inner tube mounted within an outer tube, said plurality of heat exchangers including heat exchangers of at least two different diameters, said set of diffusers being in flow communication with said inner tubes of said set of heat exchangers, the refrigeration unit selectively mounted to said outer tubes of said set of heat exchangers for selectively cooling said inner tubes to create the ice rod and for selectively heating the inner tubes to facilitate ejection of the ice rod.

5. The system of claim 4 wherein said plurality of diffusers comprises eight diffusers, said plurality of heat exchangers comprising seven heat exchangers, said plurality of air cylinders comprising two laterally movable air cylinders for selective connection to two of said heat exchangers, said plurality of staging tubes comprising seven staging tubes, said at least one molding system comprising two laterally movable molding systems, said freezer being mounted on wheels, and a bag mounted in each of said chambers of said freezer.

6. The system of claim 4 including a gravity track extending downwardly from said molding system to the freezer having an open top for depositing the hail stones into the freezer.

7. The machine of claim 6 wherein said molding system comprises a pair of heated hemispherical molds selectively movable toward and away from each other, each of said molds being mounted to a heating block whereby said molds are moved toward each other against the ice rod located between the molds to form the hail stone, and said molds being detachably mounted to said heating blocks to permit different size molds to be used.

8. The machine of claim 6 wherein said freezer has a plurality of longitudinally aligned chambers, said gravity track comprising a plurality of generally aligned pivotable levers with each lever disposed above a respective chamber whereby the hail stones travel down the gravity track to the outermost chamber of said freezer until said outermost chamber is full and said outermost lever is pivoted out of alignment with its adjacent lever so that subsequent hail stones are deposited into an adjacent chamber.

9. The machine of claim 8 wherein said gravity track includes a pair of spaced side rails, each of said levers being pivotally mounted to said side rails, and a bag mounted in each chamber for collecting the hail stones.

* * * * *